US009181744B2

(12) United States Patent
Salutzki et al.

(10) Patent No.: US 9,181,744 B2
(45) Date of Patent: Nov. 10, 2015

(54) DOOR ACTUATOR

(71) Applicants: Thomas Salutzki, Witten (DE); Alexander Hellwig, Ennepetal (DE); Jan Meulenbeld, Breckerfeld (DE)

(72) Inventors: Thomas Salutzki, Witten (DE); Alexander Hellwig, Ennepetal (DE); Jan Meulenbeld, Breckerfeld (DE)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

(21) Appl. No.: 14/361,726

(22) PCT Filed: Nov. 14, 2012

(86) PCT No.: PCT/EP2012/004723

§ 371 (c)(1),
(2) Date: May 30, 2014

(87) PCT Pub. No.: WO2013/079162

PCT Pub. Date: Jun. 6, 2013

(65) Prior Publication Data

US 2014/0366319 A1 Dec. 18, 2014

(30) Foreign Application Priority Data

Dec. 2, 2011 (DE) ..... 10 2011 055 974

(51) Int. Cl.

| | |
|---|---|
| ***E05F 3/12*** | (2006.01) |
| ***E05F 3/10*** | (2006.01) |
| ***E05F 3/04*** | (2006.01) |
| *E05F 3/22* | (2006.01) |

(52) U.S. Cl.

CPC ... *E05F 3/12* (2013.01); *E05F 3/04* (2013.01); *E05F 3/104* (2013.01); *E05F 3/227* (2013.01); *E05Y 2900/132* (2013.01); *Y10T 16/2777* (2015.01)

(58) Field of Classification Search

CPC ..... Y10T 16/2769; Y10T 16/2777; Y10T 16/2782; Y10T 16/2788; Y10T 16/2793; Y10T 16/2796; Y10T 16/56; Y10T 16/593; E05F 1/105; E05F 1/1066; E05F 3/10; E05F 3/104; E05F 3/04; E05F 3/12; E05F 3/227; E05Y 2900/132; Y10S 16/09

USPC ..... 16/53, 56–60, 71, 72, DIG. 10; 49/137, 49/339–342, 344, 350

See application file for complete search history.

(56) References Cited

U.S. PATENT DOCUMENTS

| | | | | |
|---|---|---|---|---|
| 3,474,485 | A * | 10/1969 | Milan et al. | 16/55 |
| 4,785,493 | A * | 11/1988 | Tillmann et al. | 16/53 |
| 5,417,013 | A * | 5/1995 | Tillmann | 49/386 |
| 5,901,412 | A | 5/1999 | Jentsch | |
| 7,650,669 | B2 * | 1/2010 | Bienek | 16/71 |
| 7,966,771 | B2 * | 6/2011 | Bienek | 49/340 |
| 7,971,316 | B2 * | 7/2011 | Copeland et al. | 16/79 |
| 8,415,902 | B2 * | 4/2013 | Burris et al. | 318/3 |
| 8,527,101 | B2 * | 9/2013 | Burris et al. | 700/282 |
| 8,547,046 | B2 * | 10/2013 | Burris et al. | 318/466 |
| 8,564,235 | B2 * | 10/2013 | Burris et al. | 318/466 |

(Continued)

*Primary Examiner* — William Miller
(74) *Attorney, Agent, or Firm* — Cozen O'Connor

(57) ABSTRACT

A door operator for operating a door includes a housing, an output shaft with a cam disc, an opening piston guided in the housing, which piston, on a first side, bears against the cam disc, an energy accumulator acting upon the opening piston for storing a closing energy for the door, and a damping piston guided in a cylindrically shaped hollow space of a cylinder element, and which piston, on a second side, bears against the cam disc, wherein the cylinder element is firmly connected to the opening piston.

9 Claims, 3 Drawing Sheets

(56) References Cited

U.S. PATENT DOCUMENTS 8,773,237 B2 * 7/2014 Burris et al. ..... 340/3.32
8,779,713 B2 * 7/2014 Burris et al. ..... 318/466
8,806,715 B2 * 8/2014 Bienek et al. ..... 16/53
2014/0290144 A1 * 10/2014 Hellwig et al. ..... 49/506

* cited by examiner

DOOR ACTUATOR

CROSS-REFERENCE TO RELATED APPLICATIONS

This is a U.S. national stage of application No. PCT/EP2012/004723, filed on 14 Nov. 2012, which claims priority to the German Application No. 10 2011 055 974.4, filed 2 Dec. 2011, the content of both incorporated herein by reference.

BACKGROUND OF THE INVENTION

1. Field of the Invention

The present invention relates to a door operator, in particular to a door closer for operating a door.

2. Related Art

Door operators are understood to be in particular door closers, servo-assisted door closers and door drives. In door closers, an energy accumulator is usually pre-loaded by manually actuating the door leaf. The door can be closed again without manual actuation by discharging the energy accumulator. The door closers are either attached directly to the door leaf, to a door transom or to a wall. With an attachment to a door leaf, an arm assembly is attached to the output shaft of the door closer. It is via this arm assembly that the force is transferred onto the wall, respectively onto the transom.

When mounting the door closer to the transom or to the wall, the force is transferred onto the door leaf via the arm assembly. As an alternative, it is likewise possible to connect the output shaft coaxially to the axis of rotation of the door. The problem with those prior art door closers is always the important opening momentum which is likewise required for pre-tensioning the energy accumulator. In particular when used by children, elderly people or physically handicapped individuals, an opening momentum too important is generally inconvenient and does not allow for a barrier-free access.

SUMMARY OF THE INVENTION

Therefore, it is an object of the present invention to provide a door operator manufactured in a cost-effective manner and easy to install, and which, at the highest possible closing momentum, has the lowest possible opening momentum.

The problem is solved, in one aspect of the present invention, by a door operator, in particular a door closer for operating a door, comprising a housing and an output shaft with a cam disc. In this case, the cam disc may be manufactured integrally with the output shaft or else may be mounted on the output shaft in a torque-proof manner. Furthermore, the inventive door closer comprises an opening piston guided in the housing, which, on a first side, bears against the cam disc, and an energy accumulator acting upon the opening piston and storing a closing energy for the door. Moreover, according to the invention, the door closer comprises a damping piston guided in a cylindrically shaped hollow space of a cylinder element, which damping piston bears against the cam disc on a second side. This cylinder element is firmly connected to the opening piston. The guidance of the opening piston in the housing means in particular that an exterior surface of the opening piston bears against an interior surface of the housing such that the opening piston is guided in the housing to be linearly movable. Likewise, in particular an exterior surface of the damping piston bears against an interior surface of the cylindrically shaped hollow space such that the damping piston is guided in the cylinder element to be linearly movable. The rigid connection between the cylinder element and the opening piston means in particular that the cylinder element has no degree of freedom with regard to the opening piston.

The prior art door operators with a cam disc very often encountered the problem that the two pistons are minimally tilting within their guide. As a consequence, a higher expenditure of forces was required to move the piston. In particular when opening the door and thus when moving the opening piston against the closing spring, this minimal tilting of the piston was negatively noticed in prior art applications. In the invention which is presented herein, it is by the additional cylinder element that the opening piston is supported in the housing. The minimum tilting of the opening piston is thereby reduced, preferably eliminated, and thus the efficiency of the door operator is improved.

In a preferred embodiment, it is intended that the energy accumulator comprises at least one closing spring. The closing spring is in particular configured as a compression spring. In a preferred embodiment, one end of the closing spring directly or indirectly abuts against the end of the opening piston, which end is facing away from the cam disc. The other end of the closer spring abuts against the housing, in particular against a cover of the housing at the frontal side.

Moreover, it is preferably intended that a compression spring is disposed between a side of the damping piston facing away from the cam disc and the housing. A first end of the compression spring abuts against the damping piston. The other end of the compression spring abuts in particular against a further cover in the housing at the frontal side.

In a preferred embodiment, it is intended that the opening piston comprises a first pressure roller bearing against the cam disc. The first pressure roller is supported in the opening piston to be rotatably movable. Thus, the first pressure roller allows for a low-friction transmission of forces between the opening piston and the cam disc.

Moreover, the damping piston comprises preferably a second pressure roller which bears against the cam disc. The second pressure roller is supported in the damping piston to be rotatably movable. The second pressure roller allows for a low-friction transmission of forces between the damping piston and the cam disc.

Instead of the first and/or the second pressure rollers, preferably likewise corresponding friction surfaces may be configured at the opening piston and/or at the damping piston for the transmission of forces onto the cam disc.

In a preferred embodiment, it is intended that an exterior surface of the cylinder element is guided in the housing. The exterior surface of the cylinder element is in particular cylindrically shaped. Thus, the cylinder element is supported to the inside with regard to the damping piston. To the outside, the cylinder element is guided in the housing to be linearly movable and is thus likewise supported with regard to the housing. As the cylinder element is securely connected to the opening piston, the double support of the cylinder element stabilizes likewise the opening piston and thus prevents tilting of the opening piston, improving the efficiency of the door closer.

Moreover, it is preferably intended that the output shaft with the cam disc is disposed between the opening piston and the cylinder element. As the opening piston is securely connected to the cylinder element and the cam disc is located between the two structural components, a support of the opening piston is accomplished on both sides of the cam disc.

Furthermore, it is preferably intended that the cylinder element and the opening piston together are integrally manufactured. In this case, it is in particular intended that the opening piston and the cylinder element are connected to each other by several webs.

In particular two or four webs are provided. The cam disc is located between the webs, respectively the output shaft extends therebetween. In the integral manufacturing process, in particular the opening piston, the cylinder element and all webs together are manufactured from one piece. As an alternative, it is preferably intended to separately manufacture the opening piston and the cylinder element and to connect them to each other via webs.

It is particularly preferred that the external diameter of the cylinder element corresponds to the external diameter of the opening piston. This is why the cylinder element and the opening piston can be guided in a cylindrically shaped bore in the housing, which has a constant diameter.

Furthermore, a non-return valve is preferably located in the damping piston. The non-return valve comprises in particular a sealing element, which is configured for example as a spring-loaded ball. Furthermore, the non-return valve allows in particular for discharging excess pressure from a side of the damping piston facing away from the cam disc towards the pressure-less compartment between the opening piston and the damping piston.

Preferably, a further non-return valve is provided in the opening piston. This non-return valve as well comprises in particular a sealing element, which is configured, for example, as a spring-loaded ball. The further non-return valve allows for a pressure release from the reception compartment of the closer spring towards the pressure-less compartment between the opening piston and the damping piston.

On the side of the damping piston facing away from the cam disc, a hydraulic damping compartment is preferably configured in the housing.

BRIEF DESCRIPTION OF THE DRAWINGS

The invention will now be described in more detail in relation to the drawings, reference being made to one embodiment, in which.

DETAILED DESCRIPTION OF THE PRESENTLY PREFERRED EMBODIMENTS

In the following, the door operator, formed as a door closer 1, will be explained in detail based on the FIGS. 1 to 5.

Figure 1:
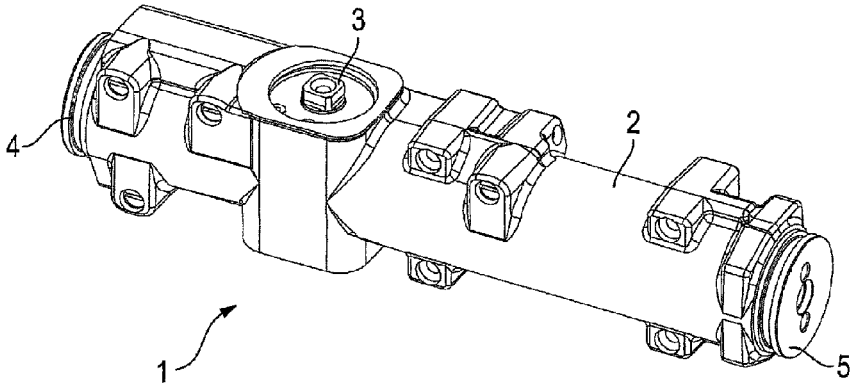
FIG. 1 shows an inventive door operator according to an exemplary embodiment.

FIG. 1 shows the door closer 1. Essentially, the door closer 1 comprises a cylindrically shaped housing 2. The two frontal side ends of the housing 2 are closed off by a first cover 4 and a second cover 5. An output shaft 3 of the door closer 1 protrudes from the housing 2. An arm assembly, for example, is attached to output shaft 3. It is via this arm assembly that the force is transferred onto the door leaf, respectively onto the wall, or onto the door transom.

Figure 2:
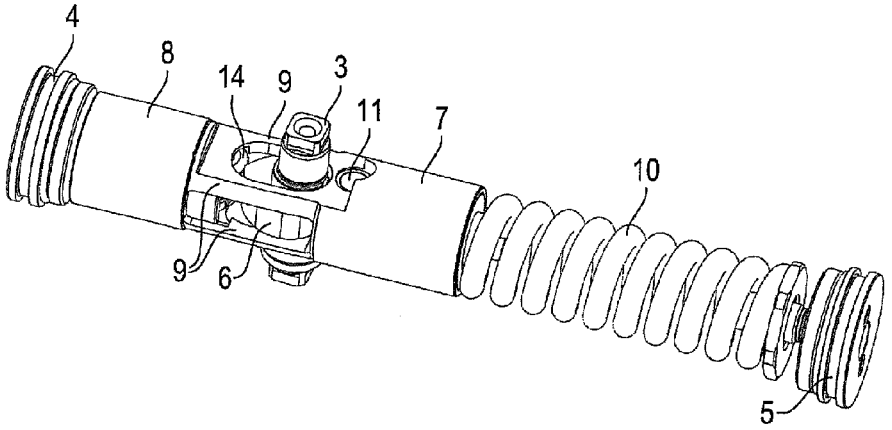
FIG. 2 shows the inventive door operator according to the exemplary embodiment without the housing.

In FIG. 2, the housing 2 of the door closer 1 is not shown. Furthermore, as can be seen in FIG. 2, the door closer 1 comprises a cam disc 6, which is connected to the output shaft 3 in a torque-proof manner. An opening piston 7 is located on one side of the cam disc 6. The opening piston 7 is supported in the housing 2 to be linearly movable. For this purpose, the envelope surface of the opening piston 7 bears against the housing 2. A cylinder element 8 is located on the other side of the cam disc 6. The cylinder element 8 is securely connected to the opening piston 7 via four webs 9. In particular the opening piston 7, the cylinder element 8 and the webs 9 together are integrally manufactured.

Figure 3:
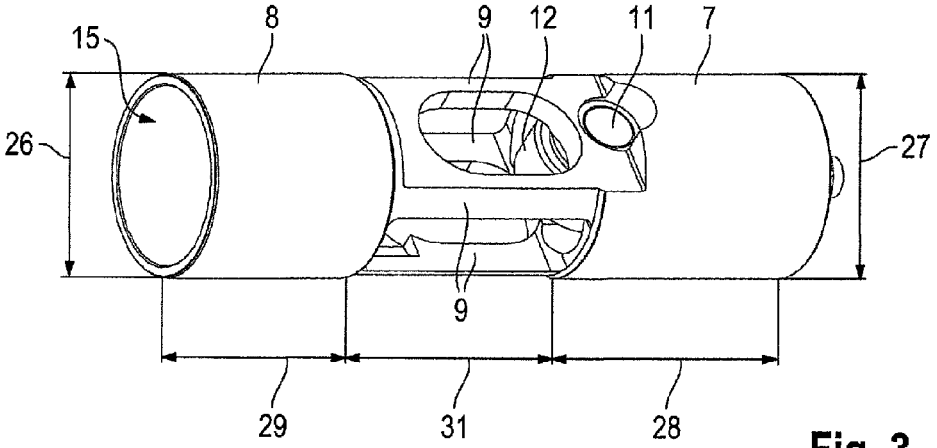
FIG. 3 shows an opening piston with a cylinder element of the inventive door operator according to the exemplary embodiment.

The opening piston 7 comprises a first pressure roller 12 (see FIG. 3). The first pressure roller 12 is supported in the opening piston 7 to be rotatably movable by a first pressure roller shaft 11. It is by the first pressure roller 12 that the opening piston 7 bears against the cam disc 6. A damping piston 16 (see FIG. 4) is supported in the cylinder element 8 to be linearly movable. The damping piston 16 comprises the second pressure roller 14, which can be seen in FIG. 2. It is by the second pressure roller 14 that the damping piston 16 bears against the cam disc 6.

A closer spring 10 (energy accumulator) is located on the side of the opening piston 7 facing away from the cam disc 6. The closer spring 10 is configured as a compression spring and, with one end, abuts against the opening piston 7, and with the other end, abuts against the housing 2, in particular against the second cover 5.

The cam disc 6 is connected to the output shaft 3 in a torque-proof manner or is integrally manufactured with the output shaft 3. The cam disc 6 is configured to be heart-shaped. By opening the door leaf, the output shaft 3 is entrained into rotation. Thereby, the cam disc 6 rotates as well. In this case, in the position illustrated in FIG. 2, the cam disc 6 pushes the opening piston 7 to the right. The closer spring 10 is thereby compressed. During a closing procedure of the door, the closer spring 10 relaxes and pushes the opening piston 7 to the left. The cam disc 6 is thereby entrained into rotation. At the same time, the damping piston 16 with the second pressure roller 14 acts in a damping manner upon the rotational movement of the cam disc 6.

FIG. 3 shows the opening piston 7 and the cylinder element 8. According to FIG. 3, a cylindrically shaped hollow space 15 is configured in the cylinder element 8. It is in this cylindrically shaped hollow space 15 that the damping piston 16 (see FIG. 4) is guided to be linearly movable. Furthermore, also the exterior surface of the cylinder element 8 is configured to be cylindrically shaped. The exterior surface of the cylinder element 8 bears against the housing 2. Thereby, the cylinder element 8 as well is guided to be linearly movable with regard to the housing 2.

Furthermore, FIG. 3 shows a first external diameter 26 of the cylinder element 8 and a second external diameter 27 of the opening piston 7. In a preferred embodiment, the first external diameter 26 is equal to the second external diameter 27 such that the cylinder element 8 and the opening piston 7 can be guided in a cylindrically shaped bore in the housing 2 having a constant diameter. Furthermore, the opening piston 7 has an opening piston length 28. The cylinder element 8 has a cylinder length 29. The opening piston 7 is guided in the housing 2 to be linearly movable over the entire opening piston length 28. The cylinder element 8 is guided in the housing 2 to be linearly movable over the entire cylinder length 29. A distance 31 is formed between the opening piston 7 and the cylinder element 8. The webs 9 extend over this distance 31 and the cam disc 6 is disposed at this distance 31. Preferably the opening piston length 28 and the cylinder length 29 comprise at least 50% of the distance 31, in particular at least 75% of the distance 31.

Figure 4:
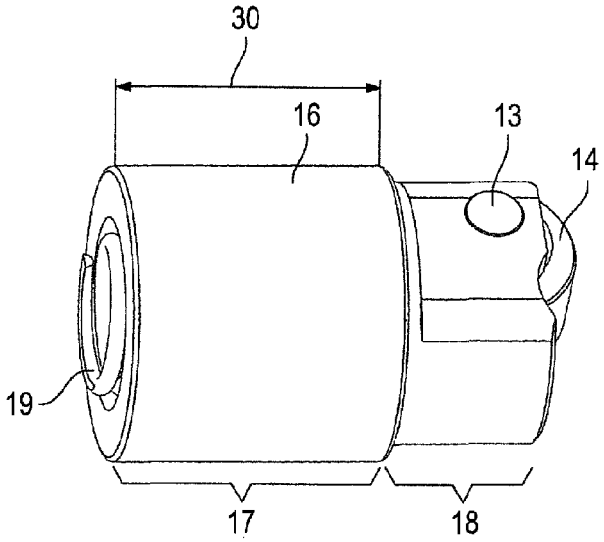
FIG. 4 shows a damping piston of the inventive door operator according to the exemplary embodiment.

FIG. 4 shows the damping piston 16. The damping piston 16 is subdivided into a guiding portion 17 and pressure roller portion 18. The guiding portion 17 features a damping piston length 30. Furthermore, the guiding portion 17 is configured with a cylindrically shaped exterior surface. The damping piston 16 is guided in particular along the entire damping piston length 30 in the cylindrically shaped hollow space 15 of the cylinder element 8 to be linearly movable. The pressure roller portion 18 is configured as an extension at the guiding portion 17. It is in this pressure roller portion 18 that the second pressure roller 14 is supported via a second pressure roller shaft 13 to be rotatably movable in the damping piston 16. Furthermore, the damping piston 16 features a hollow space. A compression spring 19 is located in this hollow space. Inside the damping piston 16, a first end of the compression spring 19 abuts against the damping piston 16. The other end of the compression spring 19 abuts against the housing 2, in particular against the first cover 4.

Figure 5:
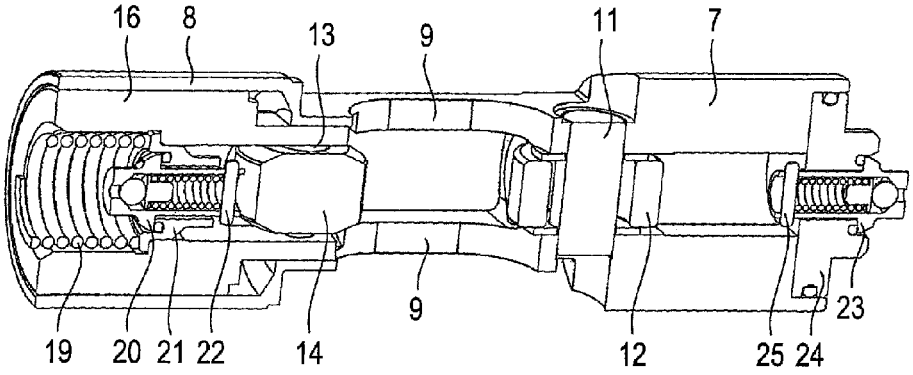
FIG. 5 shows a sectional view through the opening piston and the damping piston of the inventive door operator according to the exemplary embodiment.

FIG. 5 shows a sectional view through the opening piston 7, the cylinder element 8 and the damping piston 16. In this illustration, the damping piston 16 is inserted into the cylinder element 8.

FIG. 5 shows furthermore a first non-return valve 20 in the damping piston 16. The first non-return valve 20 is attached in the damping piston 16 via a first bushing 21 and a first pin 22. The first non-return valve 20 allows for a pressure release from the side of the damping piston 16 facing away from the cam disc 6 towards the pressure-less compartment between the damping piston 16 and the opening piston 7.

A second non-return valve 23 is located in the opening piston 7. The second non-return valve 23 is installed in the opening piston 7 via a second bushing 24 and a second pin 25. The second non-return valve 23 allows for a pressure release from the side of the opening piston 7 facing away from the cam disc 6 towards the pressure-less compartment between the opening piston 7 and the damping piston 16.

By the secure and rigid connection between the opening piston 7 and the cylinder element 8, the opening piston 7 is supported twice with regard to the housing 2, namely directly via the opening piston 7 and indirectly via the cylinder element 8, wherein the damping piston 16 is supported within the opening piston 7. A potential tilting of the opening piston 7 is thereby avoided to a large extent and thus the efficiency of the door closer 1 is improved.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A door operator (1) for operating a door, comprising:
a housing (2);
an output shaft (3) having a cam disc (6);
a cylinder element (8), an exterior surface of the cylinder element (8) bearing against the housing (2);
an opening piston (7), guided in the housing (2), the opening piston (7), on a first side, bearing against the cam disc (6);
an energy accumulator (10) configured to act upon the opening piston (7) to accumulate a closing energy for the door;
a damping piston (16) guided in a cylindrically shaped hollow space (15) of the cylinder element (8), the damping piston bearing against the cam disc (6) on a second side; and
a compression spring (19) arranged between a side of the damping piston (16) facing away from the cam disc (6) and the housing (2),
wherein the cylinder element (8) is firmly connected to the opening piston (7).

2. The door operator according to claim 1, wherein the energy accumulator (10) comprises at least one closer spring.

3. The door operator according to claim 1, wherein the opening piston (7) comprises a first pressure roller (12) bearing against the cam disc (6).

4. The door operator according to claim 1, wherein the damping piston (16) comprises a second pressure roller (14) bearing against the cam disc (6).

5. The door operator according to claim 1, wherein the exterior surface of the cylinder element (8) is guided in the housing (2).

6. The door operator according to claim 1, wherein the cylinder element (8) and the opening piston (7) together are integrally manufactured.

7. The door operator according to claim 1, further comprising a non-return valve (20) in the damping piston (16).

8. A door operator (1) for operating a door, comprising:
a housing (2);
an output shaft (3) having a cam disc (6);
a cylinder element (8), an exterior surface of the cylinder element (8) bearing against the housing (2);
an opening piston (7), guided in the housing (2), the opening piston (7), on a first side, bearing against the cam disc (6);
an energy accumulator (10) configured to act upon the opening piston (7) to accumulate a closing energy for the door; and
a damping piston (16) guided in a cylindrically shaped hollow space (15) of the cylinder element (8), the damping piston bearing against the cam disc (6) on a second side,
wherein the cylinder element (8) is firmly connected to the opening piston (7), and
wherein the output shaft (3) and the cam disc (6) are disposed between the opening piston (7) and the cylinder element (8).

9. A door operator (1) for operating a door, comprising:
a housing (2);
an output shaft (3) having a cam disc (6);
a cylinder element (8), an exterior surface of the cylinder element (8) bearing against the housing (2);
an opening piston (7), guided in the housing (2), the opening piston (7), on a first side, bearing against the cam disc (6);
an energy accumulator (10) configured to act upon the opening piston (7) to accumulate a closing energy for the door;

a damping piston (16) guided in a cylindrically shaped hollow space (15) of the cylinder element (8), the damping piston bearing against the cam disc (6) on a second side; and two or four webs (9) arranged between the opening piston (7) and the cylinder element (8) to connect the opening piston (7) to the cylinder element (8), wherein the cylinder element (8) is firmly connected to the opening piston (7).

* * * * *